United States Patent [19]

Nishikawa et al.

[11] Patent Number: 4,740,661

[45] Date of Patent: Apr. 26, 1988

[54] SEESAW SWITCH

[75] Inventors: Kikuyoshi Nishikawa; Hisashi Funakoshi; Hiroyuki Tominaga, all of Yokohama, Japan

[73] Assignee: Kabushiki Kaisha Sagami Denshi Kogyo, Kanagawa, Japan

[21] Appl. No.: 48,511

[22] Filed: May 11, 1987

Related U.S. Application Data

[63] Continuation of Ser. No. 781,600, Sep. 30, 1985, abandoned.

[30] Foreign Application Priority Data

Mar. 8, 1985 [JP] Japan ..... 60-33094[U]
May 17, 1985 [JP] Japan ..... 60-73123[U]

[51] Int. Cl.[4] ..... H01H 5/00
[52] U.S. Cl. ..... 200/68.2; 200/244; 200/275
[58] Field of Search ..... 200/67 R, 67 A, 67 B, 200/67 DB, 153 G, 162, 244, 48 KB, 248, 271, 272, 275, 339, 68.1–68.3

[56] References Cited

U.S. PATENT DOCUMENTS

| | | | |
|---|---|---|---|
| 901,509 | 10/1908 | Wilson | 200/162 |
| 1,812,914 | 7/1931 | Williams et al. | 200/67 A |
| 1,880,775 | 10/1932 | Butler et al. | 200/67 A |
| 2,269,171 | 1/1942 | Benander | 200/67 A |
| 2,794,086 | 5/1957 | Barrett | 200/248 |
| 3,989,915 | 11/1976 | Nishikawa | 200/153 G |
| 4,268,734 | 5/1981 | Sorenson | 200/302.3 |
| 4,408,105 | 10/1983 | Tanaka | 200/244 |
| 4,433,222 | 2/1984 | Kodaira | 200/153 J |

*Primary Examiner*—Henry J. Recla
*Assistant Examiner*—Linda J. Sholl
*Attorney, Agent, or Firm*—Pollock, VandeSande and Priddy

[57] ABSTRACT

A common contact and at least one fixed contact are planted on an insulating bottom panel of an insulating case. A movable contact piece formed by bending a conductive spring material into a U-shape to have a pair of opposed contact leaves is pivotally mounted on the common contact so that it is turned from side to side by an actuator such as a push button or toggle lever. As the movable contact piece turns from one side to the other, it makes sliding contact with the fixed contact gripping it between the pair of opposed contact leaves.

3 Claims, 8 Drawing Sheets

SEESAW SWITCH

This application is a continuation, of Ser. No. 781,600, now abandoned, filed on Sept. 30, 1985.

BACKGROUND OF THE INVENTION

The present invention relates to a seesaw switch of the type in which a movable contact piece performs a seesaw motion, by the actuation of a push button or toggle lever, with the fulcrum at a common contact to turn into or out of contact with at least one fixed contact provided opposite the common contact.

A conventional push-button seesaw switch usually has such a structure as shown in FIG. 1 in which a movable contact piece 1 is actuated, by the depression of a push button 11, to perform a seesaw motion with the fulcrum at a common contact 2. The switch closes as the movable contact piece 1 merely abuts against a fixed contact, and opens as they break.

The seesaw switch is commonly used to open or close a circuit which is supplied with relatively high voltage and current, for example, 4 to 5 volts or more and several tens of milliamperes. In such a circuit, even if oxide films are formed on the contacts, they are destroyed by a spark discharge which develops owing to current and voltage as the contacts make or break, and the intended contact can be maintained. Where the frequency of operations of the switch is relatively high, the possibility of an oxide film being formed is slight.

When a push-button switch of the type shown in FIG. 1 is used in a circuit which provides a start signal to a device formed by semiconductor integrated circuits, the voltage and current that are handled in such a circuit are so small that a spark discharge hardly occurs as the contacts make and break. Therefore, the formation of oxide films on the contacts would immediately lead to bad contact therebetween since there is no provision in the switch for destroying the films. Moreover, when the push-button switch is used as a start switch or the like, since the frequency of operation is relatively low, oxide films are liable to be formed on the contacts.

To avoid this, in the case of employing the pushbutton switch for a very weak current and voltage circuit, it is customary in the prior art to plate its contacts, that is, the movable contact piece 1 and the fixed contacts 3, with gold so that no oxide films are deposited on the contacts. This, however, increases the manufacturing costs of the switch, and hence is disadvantageous from the economical point of view.

Even if the contacts are plated with gold, dust or like foreign matter sticking to the contacts may sometimes cause bad contact since the switch has no provision for removing the dust or the like.

Occasionally the situation arises where a plurality of seesaw switches of the toggle lever type are disposed side by side to constitute a digital setting arrangement. When the seesaw switch is used as a digital setting switch, the frequency of operation is lower than in the case where it is used as the aforesaid start switch; therefore, it is more likely that oxide films are formed on the contacts. A conventional solution to this problem is also to plate the switch contacts with gold, but this is economically disadvantageous, as mentioned above.

To overcome the above disadvantage, Japanese Utility Model Public Disclosure No. 195735/82 gazette proposes a fully-enclosed, sliding contact type switch in which a clip-like movable contact piece 4 is provided in a manner to be slidable on the fixed contacts 3 and is actuated by a toggle lever 5, as shown in FIG. 2.

With such a sliding contact type switch, since the movable contact piece moves into or out of contact with the fixed contacts while sliding thereon, even if oxide films are formed on the contacts, they are torn off by the relative sliding movement of the contacts, providing what is called a self-cleaning action. Accordingly, the sliding contact type switch can be used with a very weak current and voltage circuit without the necessity of plating the contacts with gold.

Incidentally, the sliding contact structure is generally used in many slide switches, and the movable contact piece 4 is the most stable in operation when adapted to move horizontally along an insulating plate 6 on which the fixed contacts 3 are planted.

In the switch disclosed in the aforementioned Japanese utility model gazette, however, since the movable contact piece 4 is driven directly by the pivotal movement of the toggle lever 5, it is difficult to match the movement of the movable contact piece 4 and the movement of the toggle lever 5. The reason for this is that since the tip of the toggle lever moves in a circular arc, the gap between the insulating plate 6 supporting the fixed contacts 3 and the toggle lever 5 varies with the pivotal movement of the latter. This difficulty could be overcome by concaving the insulating plate 6 in conformity to the circular arc along which the tip of the toggle lever moves, but this presents a problem of increased manufacturing costs of the insulating plate 6.

It is therefore a primary object of the present invention to provide a seesaw switch in which a movable contact piece moves into or out of contact with a fixed contact while sliding thereon to provide a self-cleaning action, ensuring to maintain stable contact therebetween for a long period of time.

Another object of the present invention is to provide a highly durable seesaw switch in which a movable contact piece performs a seesaw motion regardless of whether the actuator is of the push-button or toggle lever type, thereby ensuring proper operation of the contact change-over mechanism.

SUMMARY OF THE INVENTION

According to the present invention, a common contact is planted at the center of the bottom of an insulating case and at least one fixed contact is planted at a distance from the common contact.

A movable contact piece is supported on the common contact so that it is capable of performing a seesaw motion with the fulcrum at the common contact while making electrical contact therewith. The movable contact piece is made by bending a conductive spring material into a U-shape to form a pair of opposed contact leaves. The movable contact piece is held in the insulating case, with the common contact firmly gripped between free end portions of the two opposed contact leaves.

In the case of a seesaw switch of the push button type, a spring is mounted in the movable contact piece at one side thereof to push it away from the bottom panel of the insulating case, retaining it in one of its two predetermined positions at all times.

The insulating case has on its top a tubular portion formed integrally therewith for slidably receiving a movable bar. A push button is mounted on top of the movable bar.

The lower end of the movable bar has a projection for engagement with one end portion of the movable contact piece at its raised position. When the push button is depressed, its downward force is transmitted through the projection to the movable contact piece to turn it.

As the movable contact piece turns to approach the fixed contact, the fixed contact slides into the region between the two contact leaves of the movable contact piece and the two opposed contact leaves slidingly contact both side edges of the fixed contact.

According to the present invention, since the movable contact piece and the fixed contact always slide into contact with each other, as mentioned above, even if oxide films are formed on the contact portions, they can be torn off; namely, the self-cleaning function is obtained.

When the actuator is of the toggle lever type, it is pivotally mounted on top of the insulating case.

The toggle lever has an internal bore which extends from its lower end along its axis and into which a spring and a push rod are loosely inserted. The push rod is resiliently biased by the spring toward the bottom panel of the insulating case.

A switcher having a flat top surface is supported on the common contact so that it can be seesawed. The push rod projecting downwardly of the toggle lever engages the top surface of the switcher to press it downwardly.

The switcher is held, by the pressure of the push rod, in one of two stable states of its seesaw motion. When the toggle lever is changed over, the push rod slides on the switcher to the opposite side across the position of its fulcrum, causing the switcher to toggle into the other stable state.

The movable contact piece is supported with its two opposed contact leaves holding therebetween the common contact at the free ends thereof so that the movable contact piece may perform a seesaw motion with the fulcrum at the common contact. A coupling member joining the two opposed contact leaves, which form the movable contact piece, has therein a hole, into which the push rod projecting out of the toggle lever is inserted for engagement with the top surface of the switcher.

Accordingly, when actuated, the toggle lever changes with a snap action from one switching state to the other by virtue of the cooperation of the push rod and the switcher, causing the movable contact piece to perform the seesaw motion.

As the movable contact piece is turned from one side to the other, the fixed contact slides into the region between the two opposed contact leaves of the movable contact piece at the side of its lowered end portion. That is to say, as the movable contact piece is tilted towards a position where it stops its seesaw motion, its two opposed contact leaves slidingly contact both side edges of the fixed contact.

As described above, also in the case of the toggle lever type actuator, since the movable contact piece always makes sliding contact with the fixed contact, even if oxide films are formed on the contact portions, they will be removed by the self-cleaning action which results from the sliding contact between the movable contact piece and the fixed contact. Accordingly, good contact between them can be maintained for a long period of time.

DESCRIPTION OF THE PREFERRED EMBODIMENTS

Figure 1:
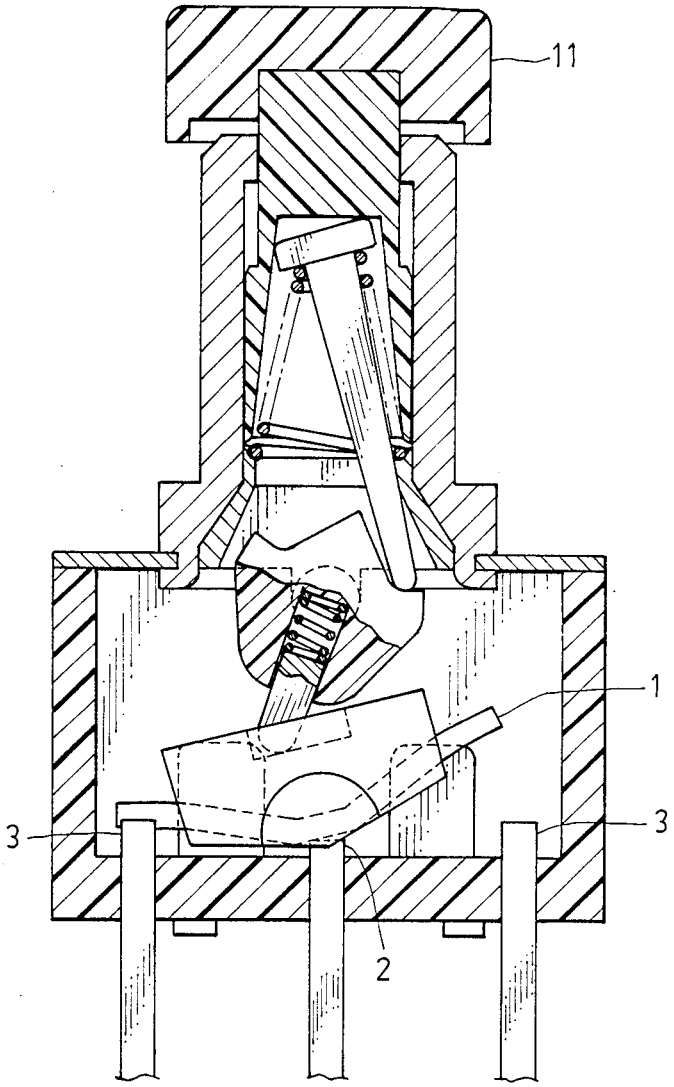
FIG. 1 PRIOR ART
FIG. 1 is a partly sectional view showing a conventional push button type seesaw switch.
Figure 3:
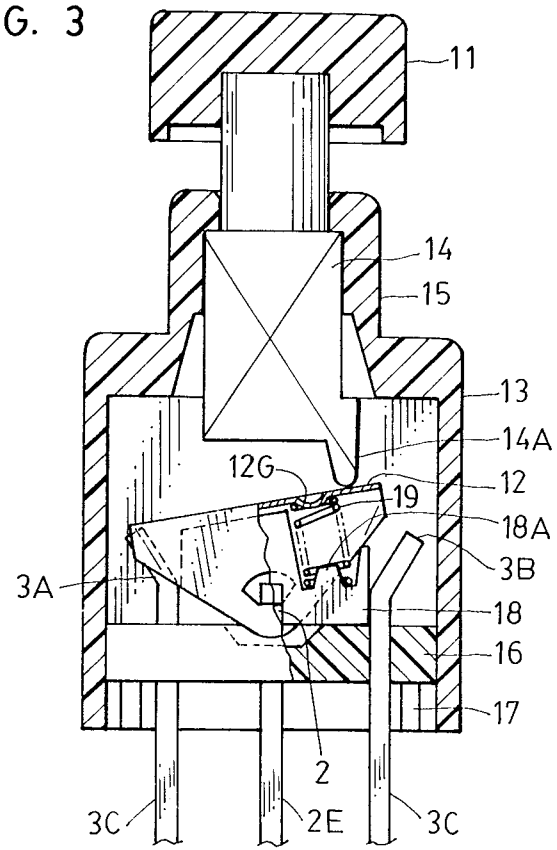
FIG. 3 is a front view, partly in section, illustrating an embodiment of the present invention as applied to the push button type seesaw switch.
Figure 2:
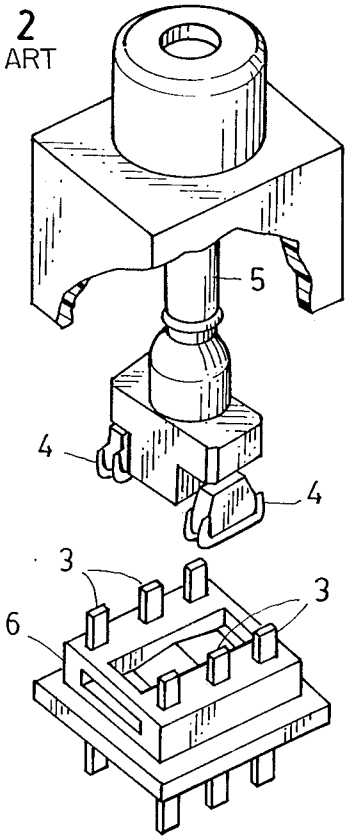
FIG. 2 PRIOR ART
FIG. 2 is an exploded perspective view showing a conventional toggle lever type seesaw switch.

FIG. 3 illustrates an embodiment of the present invention applied to a seesaw switch of the push button type, more specifically, a so-called momentary seesaw switch of the type in which when a push button 11 is depressed, a movable contact piece 12 is turned into contact with a second fixed contact 3B and when the push button 11 is released, the contact piece 12 turns out of contact with the fixed contact 3B.

In FIG. 3, reference numeral 13 indicates an insulating case of a resinous material, which has a tubular portion 15 formed integrally therewith for slidably receiving a bar 14 which is pressed down by the push button 11. The insulating case 13 has its lower end open, in which an insulating bottom panel 16 is fitted, forming the bottom of the case 13. The insulating bottom panel 16 is held in position by lugs 17 formed on the inner wall of the insulating case 13.

The insulating bottom panel 16 has a centrally disposed common contact 2 and first and second fixed contacts 3A and 3B planted on both sides thereof.

Figure 5:
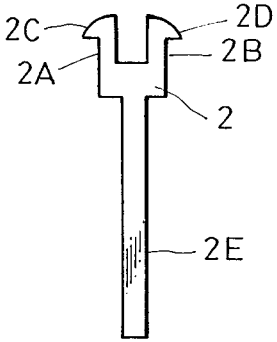
FIG. 5 is a front view showing an example of a common contact used in the embodiment depicted in FIGS. 3 and 4.

The common contact 2 has its top end portion forked off into two arms by 2A and 2B as shown in FIG. 5. The two arms 2A and 2B respectively have projections 2C and 2D the upper end faces of which are circular-arc-shaped in cross-section.

The first and second fixed contacts 3A and 3B have their upper end portions bent aslant away from the common contact 2. The common contact 2 and the first and second fixed contacts 3A and 3B project out downwardly of the insulating bottom panel 16, and their projecting ends are used as a common contact terminal 2E and fixed contact terminals 3C, respectively.

The movable contact piece 12 engages the projections 2C and 2D of the common contact 2 and turns from side to side with the fulcrum at the projections 2C and 2D.

Figure 6:
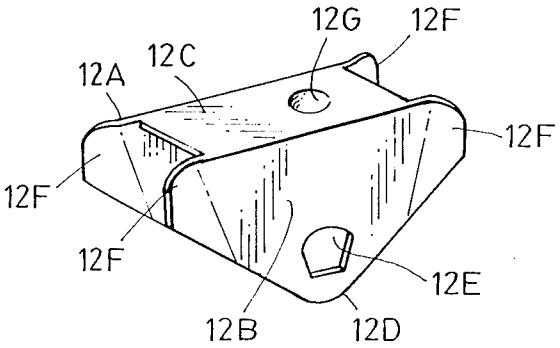
FIG. 6 is a perspective view showing an example of a movable contact piece for use in the present invention.

The movable contact piece 12 has a pair of opposed contact leaves 12A and 12B formed by bending a conductive spring material into a U- shape, as shown in FIG. 6. The two contact leaves 12A and 12B are formed substantially triangular and are coupled together at one side through a coupling portion 12C. Each contact leaf has made therein a hole 12E adjacent its vertex 12D, as viewed from the coupling portion 12C, for engagement with one of the projections 2C and 2D of the common contact 2. The movable contact piece 12 is pivotally mounted on the common contact 2 so that it turns from side to side with the fulcrum at the projections 2C and 2D engaged with the holes 12E. Incidentally, the two contact leaves 12A and 12B of the movable contact piece 12 are prestressed inwardly so that their lower end portions around the vertexes 12D tend to approach each other, ensuring to pinch therebetween the common contact 2.

Furthermore, the two contact leaves 12A and 12B of the movable contact piece 12 are bent outwardly at opposed ends adjacent the coupling portion 12C, forming two pairs of opposed contact guide arms 12F. The pairs of contact guide arms 12F respectively guide and grip therebetween the first and second fixed contacts 3A and 3B. The first and second fixed contacts 3A and 3B are each formed by a band-shaped conductive plate, which is disposed in a direction perpendicular to the plane of rotation of the movable contact piece 12. Accordingly, each pair of opposed contact guide arms 12F slidingly contact both side edges of the fixed contact 3, gripping it between them.

Disposed inside the movable contact piece 12 is an insulating block 18, which has a projection 18A (see FIG. 3) for engagement with one end of a spring 19. The other end of the spring 19 is engaged with a inward protrusion 12G formed in the coupling portion 12C of the movable contact piece 12.

The lower end of the bar 14 which is pushed down by the push button 11 has a projection 14A, the tip of which is held in contact with the coupling portion 12C of the movable contact piece 12. That is to say, the spring 19 biases the movable contact 12 to turn counterclockwise in FIG. 3 to yieldingly urge the push button 11 and the bar 14 upwardly. The bar 14 is a four-sided prismatic member which will not turn relative to the tubular portion 14 of the insulating case 13.

With such an arrangement as described above, the movable contact piece 12 is normally held in contact with the first fixed contact 3A under the action of the spring 19. When depressing the push button 11, the bar 14 is forced down and the movable contact piece 12 is turned by the projection 14A clockwise in FIG. 3.

As the push button 11 is pushed down to its extreme downward position, the movable contact 12 is disengaged at one end from the first fixed contact 3A but is engaged at the other end with the second fixed contact 3B.

In this instance, the movable contact piece 12 slidingly contact the fixed contact 3B to pinch it between the opposed contact guide arms 12F formed at the right-hand end portion of the movable contact piece 12. The sliding movement of the movable contact piece 12 and the fixed contact 3B relative to each other permits self-cleaning of their contact portions.

Releasing the push button 11, the movable contact piece 12 turns out of contact with the second fixed contact 3B while sliding thereon, ensuring to provide the self-cleaning action. Also on the side of the first fixed contact 3A, such a self-cleaning action similarly takes place.

Figure 4:
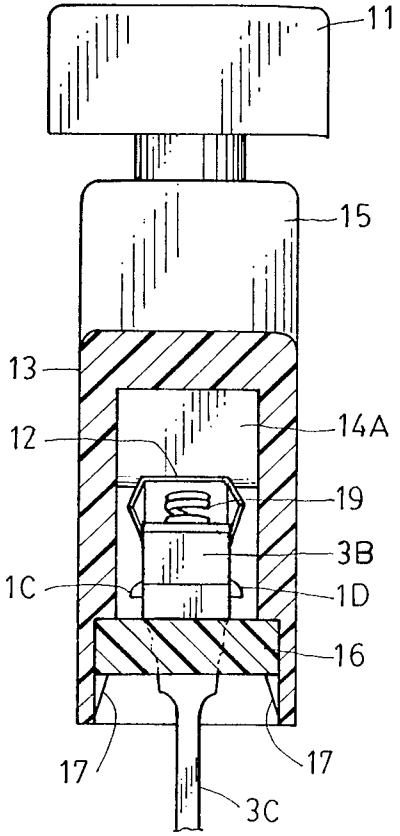
FIG. 4 is a side view of FIG. 3, partly in section.
Figure 8:
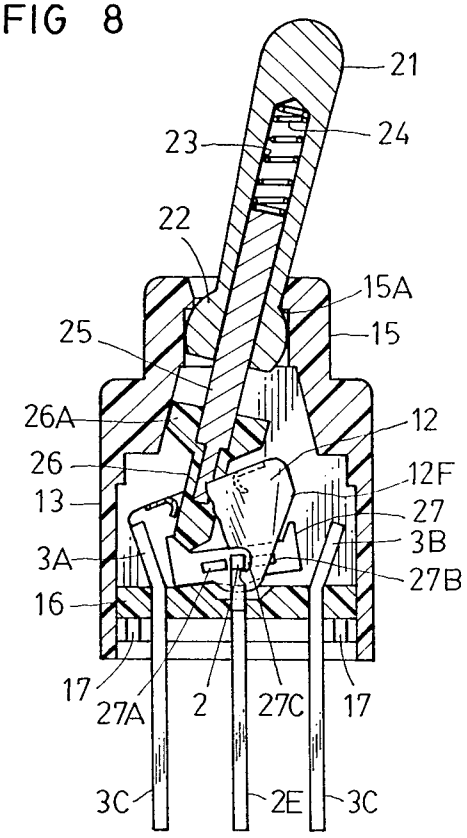
FIG. 8 is a sectional view illustrating the seesaw switch of the present invention as applied to the toggle lever type switch.
Figure 7:
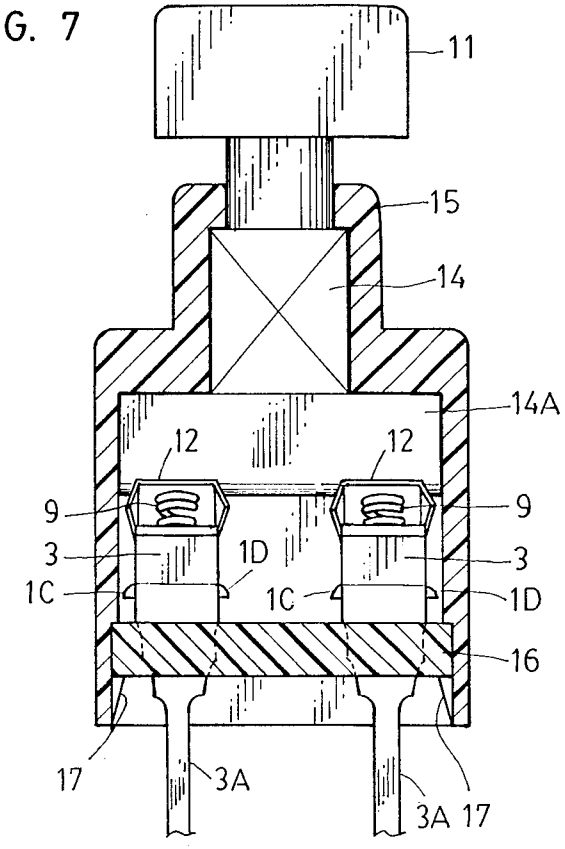
FIG. 7 is a sectional view showing the internal structure of a double-throw seesaw switch embodying the present invention.

While in the above the present invention has been described as being applied to a single-pole switch, as shown in FIG. 4, the invention is applicable as well to a doublepole switch, as depicted in FIG. 7.

Moreover, although in the above the present invention has been described in connection with a switch that has fixed contacts 3A and 3B disposed on both sides of the common contact 12, it will easily be understood that the present invention can be applied as well to a switch having only one fixed contact.

FIGS. 8 through 11 illustrate another embodiment of the present invention as applied to a toggle lever type seesaw switch. In FIGS. 8 to 11, the like parts corresponding to those in FIGS. 3 to 6 are identified by the same reference numerals. The insulating case 13 and a cylindrical portion 15 are integrally molded of resin. The lower open end of the insulating case 13 is closed with the bottom panel 16. On the underside of the bottom panel 16 are planted the common terminal 2E centrally thereof and fixed terminals 3C on both sides of the common terminal 2E.

A toggle lever 21 is inserted and pivotally supported in the insulating case 13 with its spherical portion 22 engaging the upper end 15A of the cylindrical portion 15 to prevent the toggle lever 15 from falling off. The toggle lever 21 has a bore 23 extending in its axial direction, in which a spring 24 and a push rod 25 are received so that the rod 25 is yieldingly urged by the spring 24 toward the bottom panel 16. In this example, the toggle lever 21 and the push rod 25 are made of metal and a slider 26 made of a highly wear-resistant resinous material such as nylon is attached to the lower end of the push rod 25. The slider 26 has a flange 26A of a diameter slightly smaller than the inner diameter of the shoulder portion of the insulating case 13. The movement of the toggle lever 21 and consequently the flange 26A of the slider 26 is limited by the inner wall of the insulating case 13 so that the toggle lever 21 is permitted to turn only in the direction of arrangement of the common terminal 2E and the fixed terminals 3C.

In other words, the insulating case 13 is flat and thick in the direction of arrangement of the terminals 2E and 3C but is thin in the direction perpendicular thereto. With such a flat configuration of the insulating case 13, the flange 26A is limited specifically to a rectilinear movement, permitting the toggle lever 21 to turn only in the direction of arrangement of the terminals 2E and 3C.

Disposed on the inside of the bottom panel 16 are the common contact 2 and the first and second fixed contacts 3A and 3B, which are formed by the inner end portions of the common terminal 2E and the fixed terminals 3C projecting into the insulating case 13 through the bottom panel 16. The common contact 2 has the same structure as that described previously in connection with FIG. 5, in which the top end portion of the common contact 2 is forked into two arms 2A and 2B respectively having projections 2C and 2D with sloping top end faces.

Figure 10:
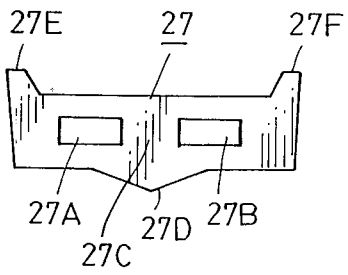
FIG. 10 is a side view showing the structure of a switcher for use in the present invention.

In the insulating case 13, a switcher 27 is pivotally mounted on the common contact 2 between its two opposed arms 2A and 2B in such a manner that it can turn from side to side. The switcher 27 is made of a highly wear-resistant resinous material and has a pair of opposed protrusions 27A and 27B on either side thereof, as shown in FIG. 10. The arms 2A and 2B of the common contact 2 are each inserted in a gap 27C defined by the protrusions 27A and 27B therebetween so as to prevent the switcher 27 from sliding out of position in its lengthwise direction. The switcher 27 has on its underside a projection 27D, which abuts on the common contact 2 to provide the fulcrum for the seesaw motion of the switcher 27. Furthermore, the switcher 27 has upward projections 27E and 27F at opposite ends in its lengthwise direction for engagement with the slider 26 attached to the tip of the push rod 25 to prevent it from slipping out of the switcher 27.

Figure 11:
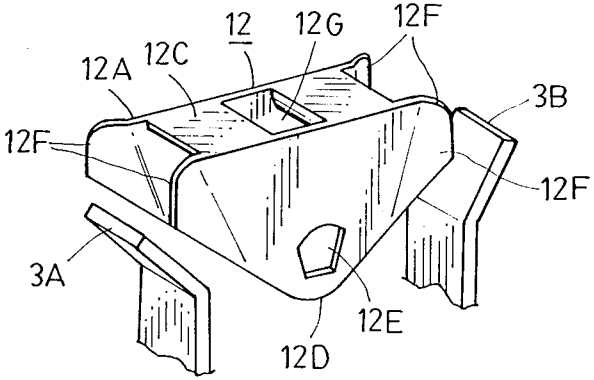
FIG. 11 is a perspective view illustrating the structure of a movable contact piece for use in the toggle lever type seesaw switch.
Figure 9:
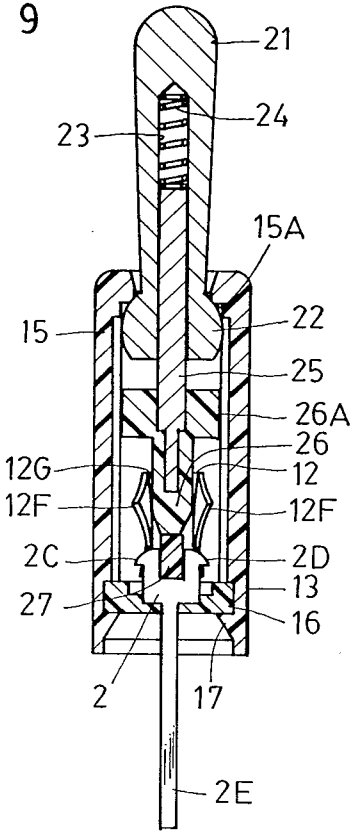
FIG. 9 is a side view of the switch of FIG. 8, partly in section.
Figure 13:
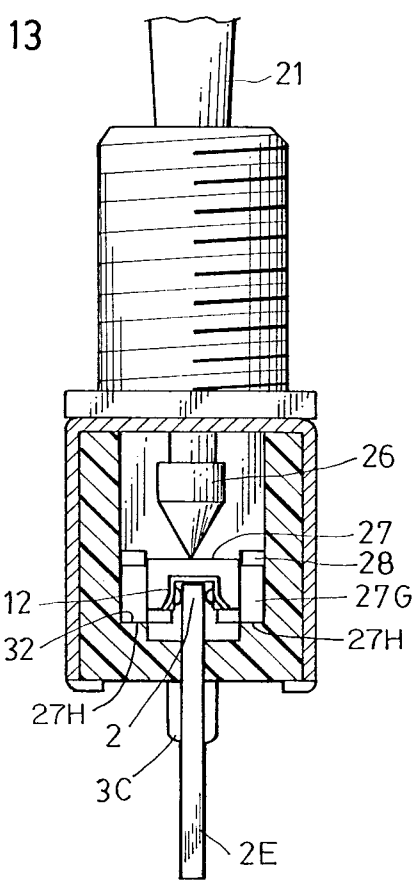
FIG. 13 is a side view of the switch of FIG. 12, partly in section.
Figure 12:
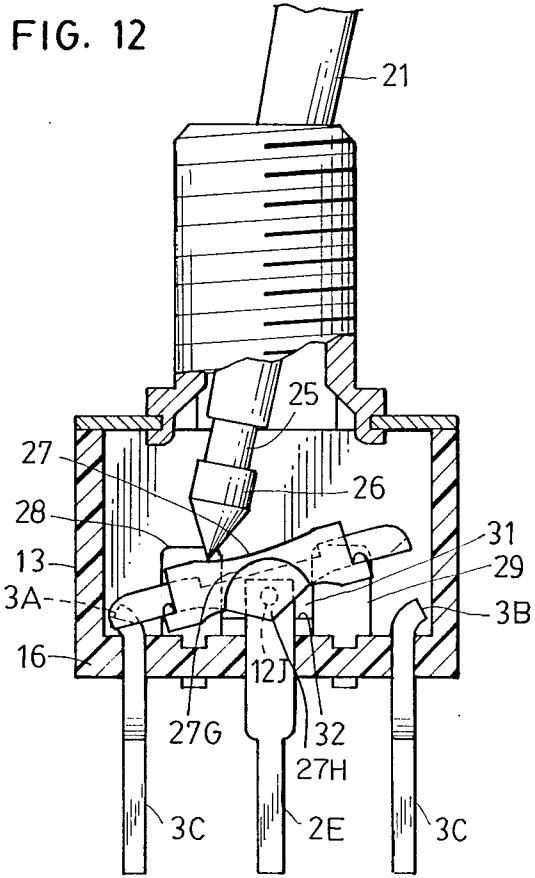
FIG. 12 is a sectional view of a toggle lever type seesaw switch of another construction.

The movable contact piece 12 is pivotally mounted on the common contact 2 in engagement with its projections 2C and 2D. As shown in FIG. 11, the movable contact piece 12 is made of a conductive spring material and is substantially identical in construction with that employed in the previous embodiment. The movable contact piece 12 has the pair of substantially triangular opposed contact leaves 12A and 12B formed as a unitary structure with each other through the coupling portion 12C. The contact leaves 12A and 12B respectively have holes 12E therein near their vertexes 12D for engagement with the projections 2C and 2D of the common contact 2. Moreover, the opposed contact leaves 12A and 12B coupled by the coupling portion 12C are prestressed inwardly so that their lower end portions around the holes 12E tend to approach each other. Consequently, the two contact leaves 12A and 12B yieldingly grip and urge therebetween the common contact 2 from the outside thereof, by which the movable contact piece 12 is pivotally supported on the common contact 2.

Furthermore, the movable contact piece 12 has the two pairs of opposed contact guide arms 12F formed by slightly bending outwardly the upper right and left corner portions of the contact leaves 12A and 12B. The coupling portion 12C has a centrally disposed hole 12G, through which the slider 26 passes for its tip to engage the switcher 27.

The fixed contacts 3A and 3B are each dimensioned to have a width that just fits into the narrowest space between the contact guide arms 12F of the movable contact piece 12. As the movable contact piece 12 turns to one side to approach either one of the fixed contacts 3A and 3B, the contact guide arms 12F come into sliding contact with both side edges of the fixed contact 3A or 3B and the movable contact piece 12 is stopped from turning when the two opposed contact leaves 12A and 12B yieldingly grip therebetween the fixed contact 3A or 3B from its both sides.

With the above structure of the toggle lever type seesaw switch, when the toggle lever 21 is actuated, the movable contact piece 12 is turned by the slider 26 to perform a seesaw motion with the fulcrum at the projections 2C and 2D of the common contact 2.

In this way, the movable contact piece 12 is turned into contact with the fixed contacts 3A and 3B alternately, electrically connecting and disconnecting the terminals 2E and 3C. The movable contact piece 12 moves into or out of contact with the fixed contacts 3A and 3B while sliding thereon. Accordingly, even if oxide films are formed on the movable contact piece 12 and the fixed contacts 3A and 3B, they will be torn off by the sliding contact, that is, the so-called self-cleaning takes place.

Therefore, the present invention offers a toggle switch which ensures to maintain good contact between the movable contact piece 12 and the fixed contacts 3A and 3B for a long period of time without the necessity of plating them with gold.

FIGS. 12 through 16 illustrate another embodiment of the toggle lever type seesaw switch of the present invention, in which the movable contact piece 12 is held by the switcher 27.

Figure 14:
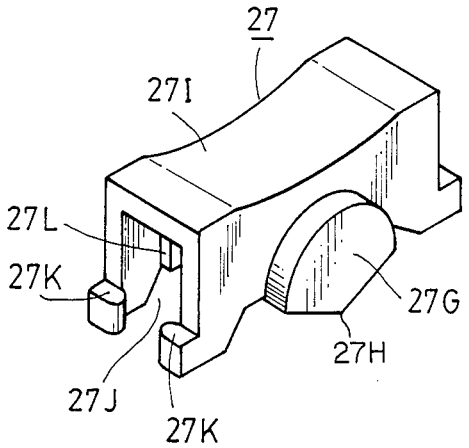
FIG. 14 is a perspective view showing a switcher for use in the seesaw switch depicted in FIGS. 12 and 13.

The switcher 27 has substantially disc-shaped projections 27G on both sides centrally in its lengthwise direction, as shown in FIG. 14. The projections 27G of the switcher 27 are fitted in a groove 31 defined by projections 28 and 29 formed on the inner wall of the insulating case 13, by which the switcher 27 is positioned. The groove 31 of the insulating case 13 has, in its lower portion, stepped portions 32, on which projections 27H each formed on the underside of one of the projections 27G of the switcher 27 abuts, pivotally supporting the switcher 27 in the insulating case 13.

The switcher 27 has in its top surface a gentle concavity 27I, as depicted in FIG. 14. The slider 26 slides on the concavity 27I, causing the switcher 27 to perform a seesaw motion in response to the switching operation of the toggle lever 21.

Figure 15:
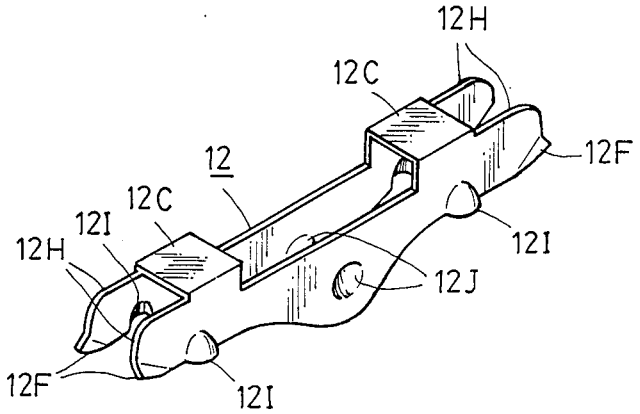
FIG. 15 is a perspective view showing a movable contact piece for use in the seesaw switch depicted in FIGS. 12 and 13.
Figure 16:
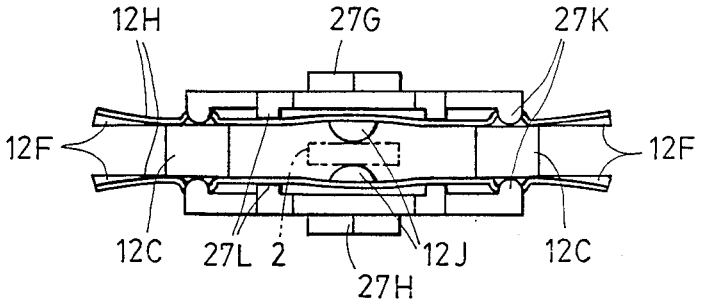
FIG. 16 is a bottom view showing an assembled structure of the switcher of FIG. 14 and the movable contact piece of FIG. 15.

The movable contact piece 12 made of conductive sheet metal is U-shaped in cross-section and has a pair of opposed resilient plate portions 12H at either end, as illustrated in FIG. 15. The resilient plate portions 12H each have a semispherical protrusion 12I on the outside thereof. The movable contact piece 12 is inserted in a groove 27J (FIG. 14) defined by the opposed side panels of the switcher 27, with the abovesaid semispherical protrusions 12I resting on projections 27K formed at both ends of the opposed side panels of the switcher 27. Thus the movable contact piece 12 is supported in the switcher 27, as depicted in FIG. 16.

Each pair of resilient plate portions 12H of the movable contact piece 12 have their lower end portions slightly bent outwardly to form the contact guide arms 12F.

As the movable contact piece 12 turns from one side to the other, the contact guide arms 12F guide the fixed contact 3A or 3B into sliding contact with the opposed resilient plate portions 12H to grip it therebetween.

The movable contact piece 12 has inward lugs 12J on its opposed side panels centrally thereof in their lengthwise direction and the lugs 12J are held in contact with the common contact 2. In order to yieldingly urge the lugs 12H against the common contact 2, opposed projections 27L are provided on the inner walls of the switcher 27 so that the movable contact piece 12 is spaced apart therefrom, as shown in FIG. 16.

While in the above arrangement the fixed contacts 3A and 3B are disposed on both sides of the common contact 2, either one of them may also be left out, as required.

Figure 17:
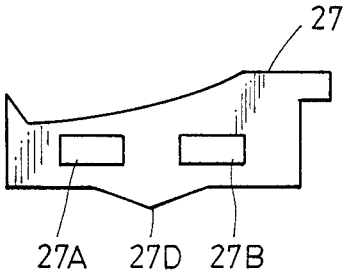
FIG. 17 is a side view illustrating another example of the switcher.

The switcher 27 may also be formed with one of its upper ends higher than the other, as shown in FIG. 17. With such a switcher 27, when releasing the toggle lever, the switch immediately returns to its initial state.

As described above, according to the embodiment illustrated in FIGS. 12 to 16, since the movable contact piece 12 is turned from side to side by the actuation of the toggle lever 21, the movement of the toggle lever 21 can properly be transmitted to the contact piece 12. This ensures stable operation of the movable contact for a long period of time, providing a highly durable toggle switch.

Furthermore, since the movable contact 12 performs a seesaw motion but makes sliding contact with the fixed contacts 3A and 3B, they are subjected to the self-cleaning action whenever they make and break. Therefore, even if oxide films are formed on these contacts, they are removed by the sliding contact of the movable contact piece with the fixed contacts. This makes it possible to maintain good contact between the movable contact piece 12 and the fixed contacts 3A and 3B for a long term. Accordingly, the present invention offers a low-cost and highly reliable toggle lever type seesaw switch which can be used with circuits handling very weak current and voltage, without the necessity of plating switch contacts with gold. Moreover, the movable contact piece can also be made of a highly conductive spring material such as phosphor bronze, german silver or the like. Gold-plating of the movable contact piece and the fixed contacts made of such a material will further increase the reliability of the seesaw switch.

It will be apparent that many modifications and variations may be effected without departing from the scope of the novel concepts of the present invention.

What is claimed is:

1. A seesaw switch comprising:

an insulating case;

a common contact mounted on a bottom panel of said case substantially centrally thereof and a fixed contact disposed in spaced relation to said common contact;

toggle lever means pivotally supported in said case;

an elongated switcher, fabricated of an insulating material, located in said case and operably associated with said toggle lever means so that said switcher is pressed by said toggle lever means to perform a seesaw motion about a substantially centrally located fulcrum positioned at said common contact thereby to retain said toggle lever means at its switched position, said elongated switcher having a pair of integral, centrally disposed disc-shaped portions which project outwardly from the opposite sides of said switcher, said disc-shaped portions being disposed respectively in a pair of grooves that are defined on the inner walls of said case to mount said switcher for pivotal motion in said case, the underside of each of said disc-shaped portions being in abutment with a part of said case to provide said centrally located fulcrum about which said switcher performs said seesaw motion, said switcher having an inverted U-shape in cross section and having elongated side walls which define a groove therebetween within said switcher, the top surface of said switcher being slidably engaged by said toggle lever means to cause said switcher to perform said seesaw motion about said fulcrum in response to a switching operation of said toggle lever means; and an elongated movable contact piece fabricated of metal, said movable contact piece having an inverted U-shape in cross section and being disposed within said groove in said switcher between said disc-shaped portions, said movable contact piece being so supported by said switcher that it is always in contact with said common contact and isolated from any forces exerted on said switcher by said toggle lever means, said movable contact piece being movable in unison with said switcher in response to the switching operation of said toggle lever means to perform the same seesaw motion as said switcher thereby to cause said movable contact piece to make contact with said fixed contact, the side walls of said inverted U-shaped movable contact piece comprising a pair of opposed contact leaves having free ends which project out of and beyond the ends of said switcher respectively, and which resiliently grip said fixed contact therebetween when said seesaw motion of said movable contact piece in unison with said switcher causes said movable contact piece to engage said fixed contact, said free ends of said contact leaves having peripheral edges which are shaped to define contact guide arms that guide said fixed contact into sliding contact between the free ends of said contact leaves.

2. A seesaw switch according to claim 1 wherein the movable contact piece has a pair of opposed inward projections on said contact leaves centrally thereof in their lengthwise direction for gripping therebetween the common contact to establish electrical connection therewith.

3. A seesaw switch according to claim 2 wherein the central portions of the contact leaves where said inward projections are formed are yieldingly supported by projections formed on the inner walls of said switcher so that the contact leaves of the movable contact piece are spaced apart from the inner walls of the switcher.

* * * * *